US011352790B2

(12) United States Patent
Kurosawa

(10) Patent No.: US 11,352,790 B2
(45) Date of Patent: Jun. 7, 2022

(54) METHOD OF INTRODUCING PRESTRESS TO BEAM-COLUMN JOINT OF PC STRUCTURE IN TRIAXIAL COMPRESSION

(71) Applicant: KUROSAWA CONSTRUCTION CO., LTD., Chofu (JP)

(72) Inventor: Ryohei Kurosawa, Tokyo (JP)

(73) Assignee: KUROSAWA CONSTRUCTION CO., LTD., Tokyo (JP)

( * ) Notice: Subject to any disclaimer, the term of this patent is extended or adjusted under 35 U.S.C. 154(b) by 0 days.

(21) Appl. No.: 16/950,846

(22) Filed: Nov. 17, 2020

(65) Prior Publication Data

US 2021/0189726 A1 Jun. 24, 2021

(30) Foreign Application Priority Data

Dec. 18, 2019 (JP) ..... JP2019-228027

(51) Int. Cl.
*E04C 3/26* (2006.01)
*E04H 9/02* (2006.01)

(52) U.S. Cl.
CPC ..... *E04C 3/26* (2013.01); *E04H 9/025* (2013.01)

(58) Field of Classification Search
CPC ... E04C 3/26; E04C 3/34; E04H 9/025; E04H 9/021; E04H 12/16; E04B 1/22; E04B 1/06; E04G 21/12; B28B 23/06
See application file for complete search history.

(56) References Cited

U.S. PATENT DOCUMENTS 2,786,349 A * 3/1957 Coff ..... E04B 1/22 52/223.4
3,158,959 A * 12/1964 Ratliff, Jr. ..... E04B 1/94 52/223.8

(Continued)

FOREIGN PATENT DOCUMENTS

JP 2005-023603 A 1/2005
JP 4041828 B2 2/2008

(Continued)

OTHER PUBLICATIONS

U.S. Appl. No. 16/897,267, filed Jun. 10, 2020.

*Primary Examiner* — Gisele D Ford
(74) *Attorney, Agent, or Firm* — SGPatents PLLC

(57) ABSTRACT

There is provided a method of introducing prestress into a beam-column joint of PC construction to make it into a triaxially compressed state, in which the beam-column joint is made into a triaxial compression state and reasonable prestress is introduced into cross section areas of the ends of the members forming the beam-column joint.

A tensile introducing force is generated by tensionally anchoring PC cables passed through the beam-column joint to introduce prestresses into the cross section areas of the ends of the members forming the beam-column joints in respective axial directions to make triaxial compression state, to satisfy the following conditions (1) and (2):

(1) no tensile strength is generated, with respect to long term design load, in cross-section areas of the members forming the end of the beam and the end of the column, which ends are in contact with the beam-column joint; and (2) upon occurring of extremely large scale earthquake (very rarely occurred earthquake), in the beam-column joint, no generation of diagonal cracks is allowed to be generated but diagonal tensile stress intensity caused (Continued)

due to shear force inputted by seismic load is made less than allowable tensile stress intensity of concrete.

1 Claim, 16 Drawing Sheets

(56) References Cited

U.S. PATENT DOCUMENTS

| | | | | |
|---|---|---|---|---|
| 3,343,808 | A * | 9/1967 | Howlett | E04G 21/121 254/133 R |
| 4,574,545 | A * | 3/1986 | Reigstad | E04G 23/0218 264/228 |
| 5,809,711 | A * | 9/1998 | Werner | E01D 2/00 52/223.2 |
| 9,534,411 | B2 | 1/2017 | Kurosawa | |
| 10,934,734 | B1 * | 3/2021 | Al-Salloum | E04H 9/021 |
| 2004/0103612 | A1 * | 6/2004 | Jo | E04C 3/26 52/655.1 |
| 2015/0330095 | A1 | 11/2015 | Kurosawa | |
| 2018/0127966 | A1 * | 5/2018 | Kurosawa | E04B 1/30 |

FOREIGN PATENT DOCUMENTS

| | | | |
|---|---|---|---|
| JP | 5612231 | B1 | 10/2014 |
| JP | 6644324 | B1 | 2/2020 |
| JP | 6747734 | B1 | 8/2020 |

* cited by examiner

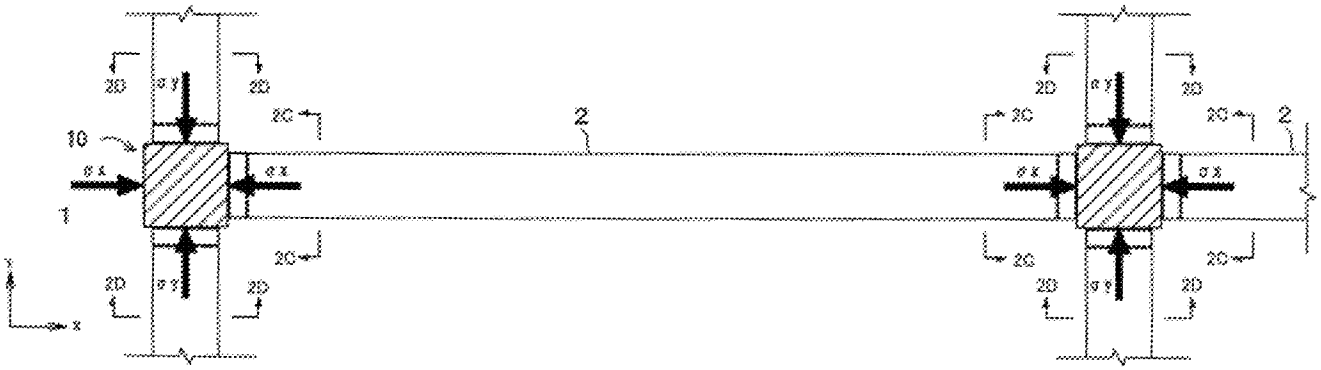
2
20
20
20

METHOD OF INTRODUCING PRESTRESS TO BEAM-COLUMN JOINT OF PC STRUCTURE IN TRIAXIAL COMPRESSION

Priority is claimed on Japanese Patent Application No. 2019-228027 filed on Dec. 18, 2019, the content of which is incorporated herein by reference.

TECHNICAL FIELD

The present invention relates to a method of introducing prestress into a beam-column joint (or column-beam joint) of a prestressed concrete structure (PC structure) to establish triaxial compression.

BACKGROUND ART

It is demonstrated by many studies in the past that a beam-column joint formed by concrete members extending in three axial directions (i.e. beams extending in two horizontal directions x and y and columns extending in the vertical direction z) may develop diagonal shear cracks caused by a diagonal tensile force. Such cracks of the concrete members thus damaged develop further to cause brittle fractures without toughness. Such breaking of the beam-column joint directly leads to collapse of the structural frame, eventually resulting in fatal shear fractures of the entire structure.

Patent literatures in the citation list below disclose various methods of reinforcing beam-column joints in order to prevent diagonal cracks from occurring in them.

Patent Literature 1 (Japanese Patent Application Laid-Open No. 2005-23603) discloses a reinforcing method for a beam-column joint of a reinforced concrete structure (RC structure). According to Patent Literature 1 (JP2005-23603), in a beam-column joint of a concrete structure, the upper beam main reinforcing bars extending from the end face of each beam into the beam-column joint extend obliquely downward toward the end face of the opposed other beam, further extend horizontally into the opposed other beam from the end face thereof, and are fixed to constitute the lower beam main reinforcing bars of the opposed other beam, and the lower beam main reinforcing bars extending from the end face of each beam into the beam-column joint extend obliquely upward toward the end face of the opposed other beam, further extend horizontally into the opposed other beam from the end face thereof, and are fixed to constitute the lower beam main reinforcement bars of the opposed other beam. This arrangement reduces the tensile principal stress and increases the compressive principal stress.

Patent Literature 2 (U.S. Pat. No. 9,534,411) discloses a two-stage nonlinear resilient aseismatic design for a PC structure in which precast concrete members constituting columns and beams are connected together by pressure connection (or binding juncture) achieved by secondary cables that pass through a panel zone (i.e. beam-column joint). In this two-stage nonlinear resilient aseismatic design, the beam-column joint in pressure connection is kept in a fully prestressed joint state against seismic loads below a design limit. When a great seismic load exceeding the design limit acts on it, the beam-column joint is brought into a partially prestressed joint state to prevent fatal damages of the main structural members (i.e. columns, beams, and panel zone) from occurring.

In Japanese patent application No. 2019-167793 which matured into Japanese patent No. 6644324 and is published on Feb. 12, 2020, the applicant of the present application has proposed:

A method of introducing prestress in a beam-column joint that introduces prestress in a beam-column joint in a multi-story building structure constructed by PC columns and PC beams with a tensile introducing force generated by tensionally anchoring PC cables that are arranged in PC beams extending along two horizontal directions (or X axis and Y axis) and PC columns extending along the vertical direction (or Z axis) and passed through the beam-column joint to bring the beam-column joint in triaxial compression, the prestress being introduced such that a diagonal tensile force generated by an input shear force due to a seismic load of an extremely great earthquake that may occur very rarely will be cancelled Completely or partially so as not to allow diagonal cracks to occur, wherein the ratio of the prestresses introduced in the directions of the respective axes satisfies the prescribed equation.

CITATION LIST

Patent Literature

Patent Literature 1: Japanese Patent Application Laid-Open No. 2005-23603

Patent Literature 2: Japanese Patent No. 5612231 that corresponds to U.S. Pat. No. 9,534,411

Patent Literature 3: Japanese Patent No. 4041828

SUMMARY OF INVENTION

Technical Problem

In the structure disclosed in Patent Literature 1 (JP2005-23603), main reinforcing bars are arranged to extend obliquely from the end face of one beam into the beam-column joint and fixed to the end face of the other beam to thereby reduce the tensile principal stress.

However, as is well known, the reinforcing bars cannot prevent cracking of an RC (reinforced concrete) structure from occurring. The role of the reinforcing bars is to prevent or reduce development of cracks after the occurrence thereof to prevent enlargement of the crack width. In other words, the reinforcing bars cannot proactively prevent the occurrence of cracks but merely prevent or reduce the development of cracks only after their occurrence.

Therefore, even if the reinforcing bars are arranged in the manner disclosed in Patent Literature 1 (JP2005-23603), it is not possible to proactively prevent the diagonal cracks in the beam-column joint from occurring. In other words, what is disclosed in Patent Literature 1 (JP2005-23603) is prevention or reduction of development of cracks merely reactive to their occurrence. Therefore, this structure cannot prevent deterioration in the resistance against earthquakes or the durability of the beam-column joint due to the occurrence of diagonal cracks, if seismic loads act on the beam-column joint repeatedly.

Other problems with the structure disclosed in Patent Literature 1 (JP2005-23603) are that the number and the diameter of the upper beam main reinforcing bars on the end face of one beam and the number and the diameter of the lower beam main reinforcing bars on the end face of the other beam are not necessarily equal to each other and that bending and obliquely arranging the reinforcing bars take much effort. Moreover, the arrangement of the reinforcing bars in the beam-column joint is complicated, and they do not fit in the beam-column joint neatly. This can lead to uneven pouring of concrete, likely resulting in the occurrence of honeycombs due to unsatisfactory pouring.

The following descriptions are found in Patent Literature 2 (U.S. Pat. No. 9,534,411):

"At a panel zone (a column-beam junction), a prestress is applied to a great beam, which is a beam in a span direction, a girder beam, which is a beam in a longitudinal direction, and the column. Thereby the panel zone receives a prestress force three-dimensionally in all directions of X, Y, and Z."

"Axial compressions are added three-dimensionally to the panel zone, which thereby has a restoration force characteristic by the prestress. This prevents residual deformation after the earthquakes perfectly. This is a completely different design idea from that of the related art, in which the destruction of the panel zone in the RC construction and the PC construction absorbs energy."

Based on this design principle, prestress is introduced in a beam-column joint in three axial directions to proactively cancel diagonal tensile forces acting in the beam-column joint by earthquakes. In consequence, diagonal tensile forces will not be generated, and shear fractures will be prevented completely. This eliminates the need for many diagonal reinforcing bars like those described in Patent Literature 1 (JP2005-23603), thereby solving the problem of honeycombs of concrete in the beam-column joint (or panel zone).

While Patent Literature 2 (U.S. Pat. No. 9,534,411) describes a design principle of a beam-column joint (or panel zone) in triaxial compression, it does not describe a specific way of introducing prestress in three axial directions.

Generally speaking, while the working load on a beam generates little axial force in it, the working load on a column always generates an axial force in it. The direction of the axial force is not constant but varies depending on the type of the working load. While the axial force generated in a column by the stationary load (vertical load) is compressive force, axial forces generated by accidental loads (horizontal loads) due to earthquakes, winds, etc. include compressive forces and tensile forces. Strong tensile or compressive forces tend to be generated in outer columns arranged on the outer circumference of buildings and corner columns by seismic loads.

The magnitude of the axial force in columns varies depending on the floor level. In tall buildings and extremely tall buildings, the difference in the axial force in columns is very large between the top floor and the bottom floor, and the magnitude and direction (compressive or tensile) of axial forces generated in columns by working loads are not uniform but vary.

Further, a current beam-column joint (panel zone) is composed of the ends of the columns and the ends of the beams crossed each other. However, cross sections of the column and of the beam at the respective ends thereof are not the same but different from each other, and there are many cases where cross sections forming the beam ends in the two horizontal directions (X and Y), are different depending on axial directions.

In order to establish a triaxially compressed state of the beam-column joint, since it is necessarily associated with introducing prestresses into cross sections of the ends of the columns and of the ends of the beams which surround the beam-column joint, it is required to establish a method for introducing prestresses into the beam column-joint and also into the cross sections of the ends of the columns and the ends of the beams which surround the beam-column joint.

In the current design practice for the PC construction, there are two ways for calculation regarding cross section of each member against bending stresses due to long term design load, one of which does not allow any tensile stress intensity to be generated in cross section of each member, that is, a socalled fully prestressed state is established, and the other of which establishes a socalled partially prestressed state where tensile stress intensity introduced in the cross section of each member is made to be lower than an allowable tensile stress intensity of concrete. Thus, one of the two ways is selected in accordance with the use conditions of a building and required performance for the building to calculate and determine prestress forces required to be introduced in the respective directions.

However, with respect to generation of diagonal cracks at the beam-column joint caused due to seismic load that is short term design load, the current calculation method in which the prestressing tendons are deemed as reinforcing bars based on the RC (reinforced concrete) design method in the same thinking as for the RC construction, is effective against tensile stress in order to control width of cracks once after the cracks have been generated, but this calculation method is not effective to prevent cracks from being generated beforehand.

In other words, no method of introducing prestress into a beam-column joint (or column-beam joint) so as not to generate diagonal cracks therein upon occurring of extremely large or huge scale earthquake, has yet been established.

The present invention which develops further the design method disclosed in the applicant's earlier Japanese application No. 2019-167793 (now Japan Patent No. 6644324 on Jan. 10, 2020), provides a method for reasonably introducing prestress into the beam-column joint (or panel zone) to bring the same into a triaxially compressed state and, in addition, for introducing prestress into cross-section areas of the ends of the beams and of the ends of the columns forming the beam-column joint.

Solution to Problem

According to the present invention, there is provided a method of introducing prestress in a beam-column joint that introduces prestress in a beam-column joint in a multi-story building structure constructed by PC columns and PC beams with a tensile introducing force generated by tensionally anchoring prestressing tendons that are arranged in PC beams extending along two horizontal directions (or X axis and Y axis) and PC columns extending along the vertical direction (or Z axis) and passed through the beam-column joint to bring the beam-column joint in triaxial compression, being characterized in that prestresses $\sigma x$, $\sigma y$ and $\sigma z$ introduced in the respective directions are determined to satisfy the following conditions (1) and (2), where $\sigma x$, $\sigma y$ and $\sigma z$ are prestresses introduced in the directions of the X axis, the Y axis, and the Z axis respectively:

(1) no tensile stress intensity is generated, with respect to long term design load, in cross-section of the ends of the beams and of the ends of the columns which form the beam-column joint; and (2) upon occurring of extremely large scale earthquake (very rarely occurred earthquake), in the beam-column joint, no generation of diagonal cracks is allowed, and diagonal tensile stress intensity caused due to input shear forth by seismic load is made less than an allowable tensile stress intensity of concrete.

Further, it is characterized in that the values of σx, σy and σz fall within the ranges as shown below:

$2.0 \leq \sigma x \leq 10.0$ (N/mm$^2$)

$2.0 \leq \sigma y \leq 10.0$ (N/mm$^2$)

$0.6 \leq \sigma z \leq 9.0$ (N/mm$^2$)

Advantageous Effects of the Invention

Advantageous effects of the present invention are as follows.

(1) According to the prestress introducing method taken into consideration the beam-column joint and in addition the cross section of the ends of the beams and the ends of the columns forming the beam-column joint in the respective directions, the cross section of the ends of the beams and the ends of the columns in the respective directions satisfy required construction performances and the beam-column joints are brought into the triaxially compressed states, so all or almost all of diagonal tensile forces caused along the diagonal lines of the beam-column joints due to input shear forces in the beam-column joints by seismic load are cancelled, thereby diagonal cracks being prevented from generated upon occurring of earthquakes, and moreover in the cross section of the ends of beams and the ends of columns in the respective directions, prestresses being able to be introduced reasonably and without difficulty respectively.

(2) Based on the above described ranges of the prestresses to be introduced, the values of σx and σy determined according to the present invention may be limited within the range between 2.0 and 10.0 N/mm$^2$, and then, the value of σz may be limited within the range between 0.6 and 9.0 N/mm$^2$ according to the reduced ratio specified with taking the influence of the axial force of the column into account. The above ranges are set based on the design standard strength Fc of concretes that are commonly used in PC (prestressed) constructions (Fc=40 N/mm$^2$-60 N/mm$^2$). This does not require excessively low or excessively high stress introducing forces and allows reasonable and cost-effective designs.

(3) There may be cases where a diagonal tensile force generated in a beam-column joint by an extremely great earthquake is partly cancelled by the prestress introduced therein and partly remains. If the prestress is introduced such that a tensile stress intensity resulting from the diagonal tensile force will not exceed the allowable tensile stress intensity of the concrete used to construct the beam-column joint even in such cases, diagonal shear cracks fatal to the building structure will not occur. This ensures aseismatic performance of the building.

(4) The method of introducing prestress according to the present invention is based on a principle that is completely different from conventional RC constructions, in which reinforcing bars are provided in a beam-column joint in order to reactively prevent development of cracks after they occur. The method of introducing prestress according to the present invention brings a beam-column joint in triaxial compression or triaxially compressed state with a most reasonable balance that is set taking into consideration factors leading to variations in the axial forces acting on the columns. This proactively cancels tensile forces that may cause cracks to reliably prevent cracks from occurring.

BRIEF DESCRIPTION OF DRAWINGS

FIG. 1A is a plan view and FIG. 1B is a side view.

FIGS. 2A to 2E illustrate beam-column joints in triaxial compression according to the present invention.

FIG. 2A is a plan view; FIG. 2B is a side view; FIG. 2C is an 2C-2C cross sectional view of the beam shown in FIGS. 2A and 2B; FIG. 2D is a 2D-2D cross sectional view of the beam shown in FIG. 2A; and FIG. 2E is a 2E-2E cross sectional view of the column shown FIG. 2B.

FIG. 6A is a plan view, FIG. 6B is a side view, and FIG. 6C is a cross sectional view of a beam.

FIG. 8-1A is a view showing a structure of an analytical model for FEM analysis, and FIG. 8-1B is a mesh division view showing a frame structure and PC tensioning force.

FIG. 8-2A and FIG. 8-2B are views showing prestress distributions introduced into the horizontal directions (beam directions) and the column direction of the beam-column joint.

FIG. 8-3 is a view showing comparisons between the PC frame and the RC frame to which forced displacements applied horizontally.

FIG. 8-4A and FIG. 8-4B are views showing tensile stress generated zones caused in the PC and RC respective beam-column joints.

FIG. 8-5A and FIG. 8-5B are views showing tensile stress generated zones caused in the PC and RC respective beam-column joints.

EMBODIMENTS FOR CARRYING OUT THE INVENTION

Figure 1A:
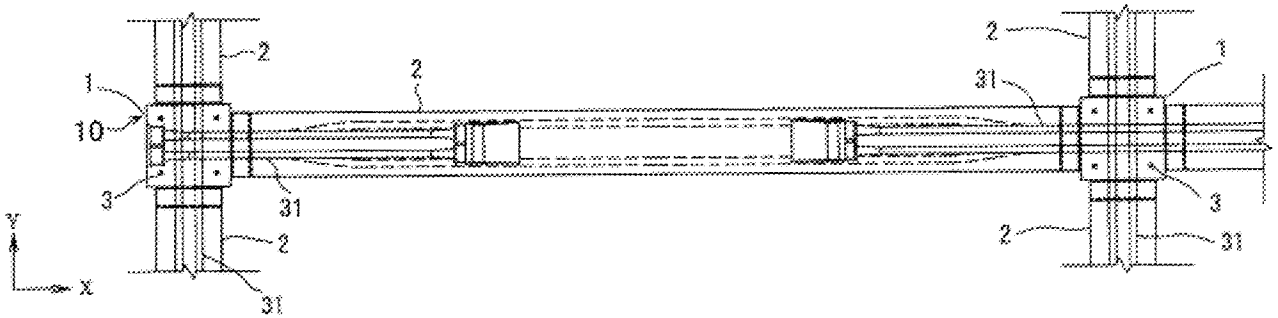
FIGS. 1A and 1B show a portion of a middle floor of a building including beam-column joints constructed only by precast PC members according to the present invention.
Figure 1B:
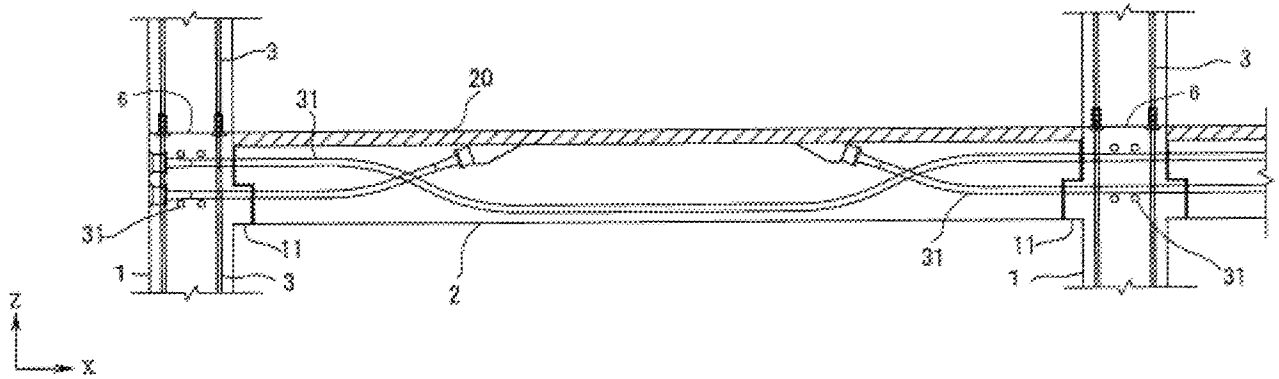
Figure 3:
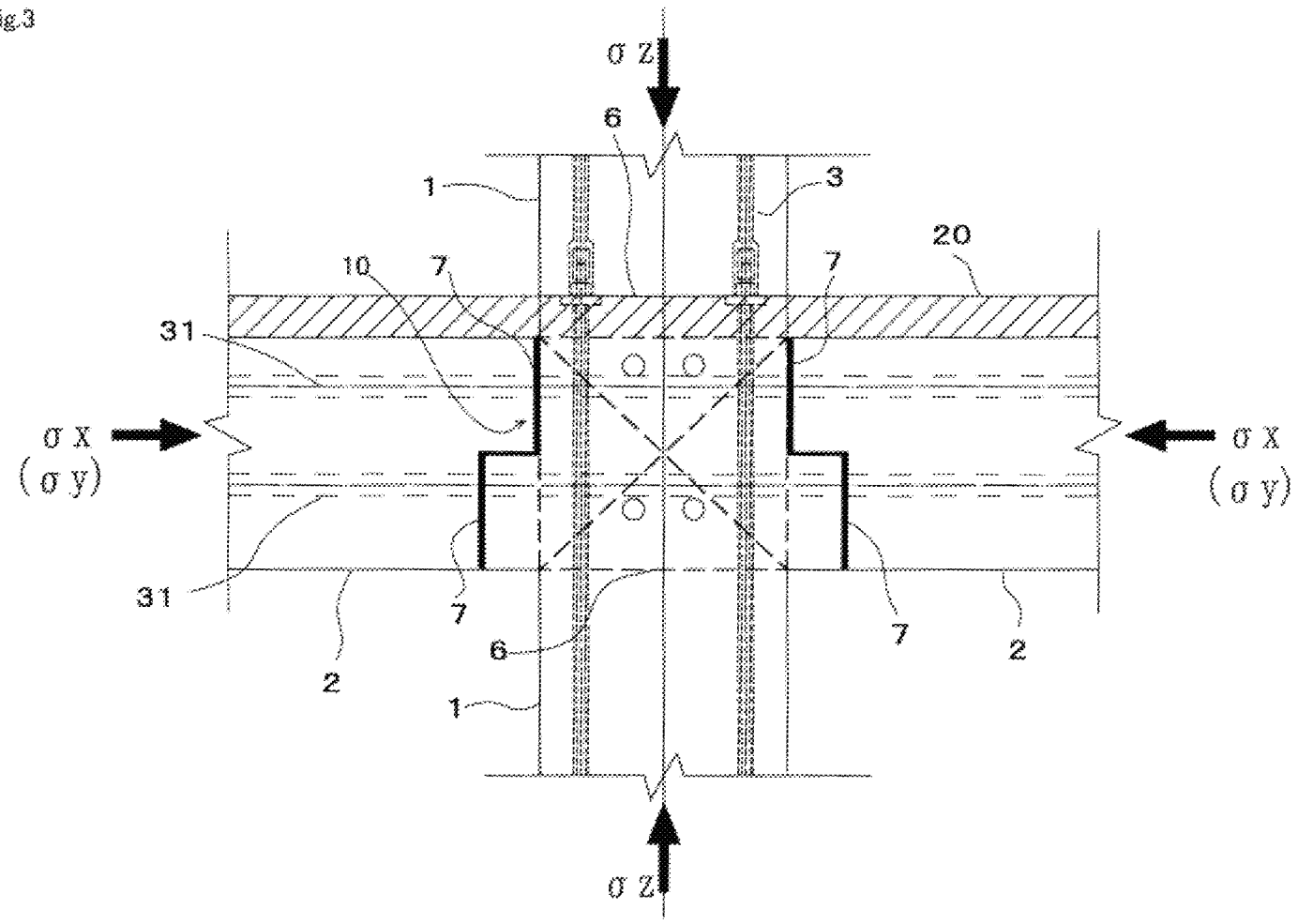
FIG. 3 is an enlarged side view showing a portion of the beam-column joint shown in FIG. 1.

FIGS. 1A and 1B show a portion of a building to which the present invention is applied. FIGS. 1A and 1B are, respectively, a plan view and a side view of the pc columns 1, the PC beams 2 and the beam-column joints 10 in a middle floor of a multi-story building. The beam-column joint 10 is formed by the column ends 6 and the beam ends 7 crossed each other, as shown in FIG. 3.

PC columns 1 and PC beams 2 in the structure shown in FIGS. 1A and 1B are precast members. The PC columns 1 are set upright on the foundation (not shown). Prestressing steel rods 3 serving as prestressing tendons are passed through the PC column 1 and tensionally anchored (in other words, fixed in a tensioned state). The PC beams 2 are set on corbels or coggings 11 provided on the PC columns 1. Prestressing cables 31 provided in the PC beams 2 serving as prestressing tendons are passed through the beam-column joints and tensionally anchored.

As shown in FIGS. 1A and 1B, the prestressing steel rods 3 and the prestressing cables 31 serving as prestressing tendons are passed through the beam-column joint 10 in two horizontal directions (X, Y) and the vertical direction (Z) and tensionally anchored to introduce prestress in the beam-column joint 10.

Components and features of the structure that are not directly relevant to the present invention are similar to those in conventional structures and will not be described in detail. For example, as in conventional structures, the PC columns and the PC beams are connected together using the prestressing tendons fixed in a tensioned state, and top concrete and a slab are formed on top of the precast PC beams to form composite beams.

The PC columns and the PC beams mentioned in the description of the present invention are prestressed concrete structural components.

Pressure connection of a precast PC column and a precast PC beam achieved only by prestressing tendons without the use of reinforcing bars will be referred to as full pressure connection, and connection achieved by both reinforcing bars and prestressing tendons will be referred to as semi pressure connection.

Figures 1A, 8:
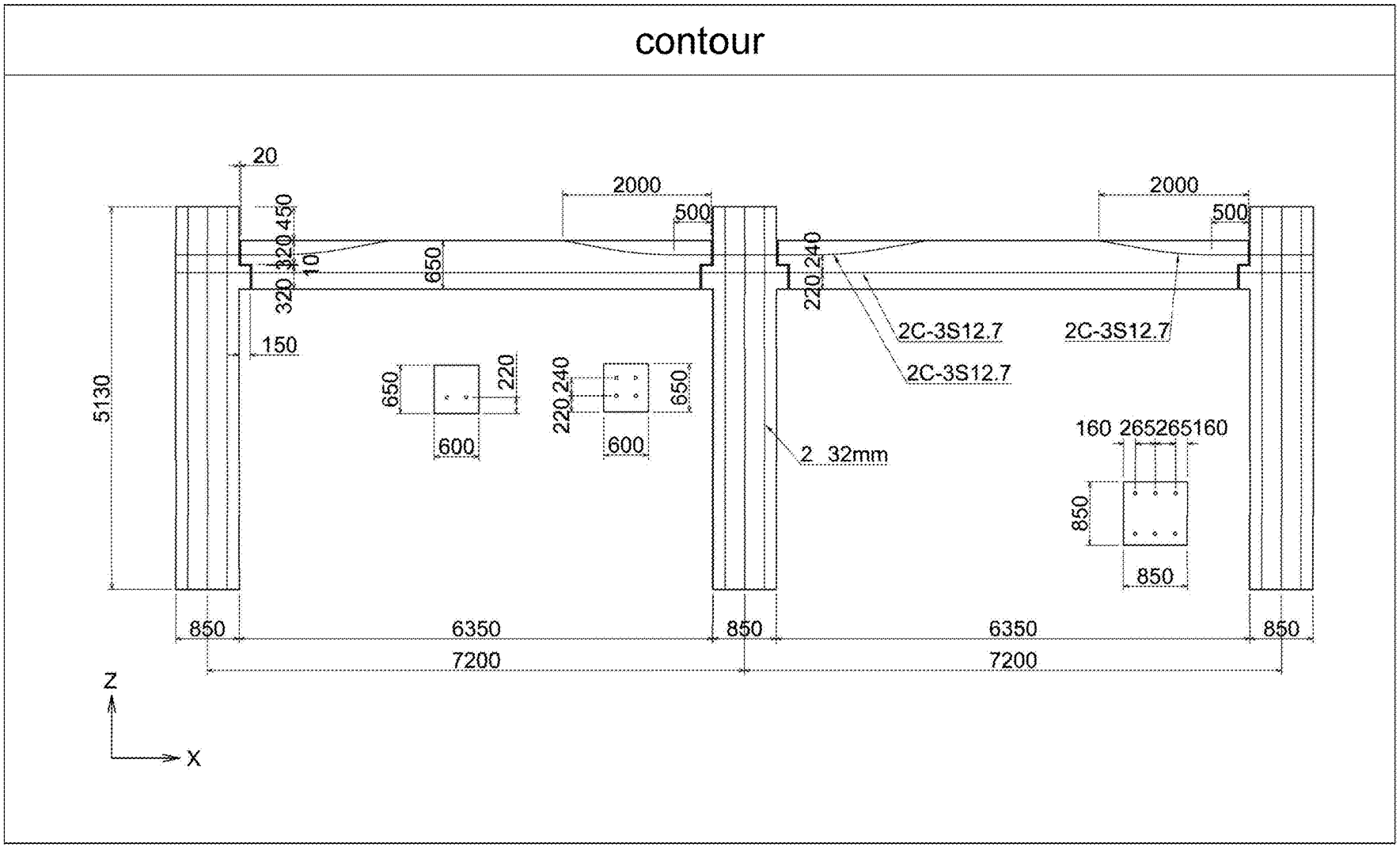
Figures 1B, 8:
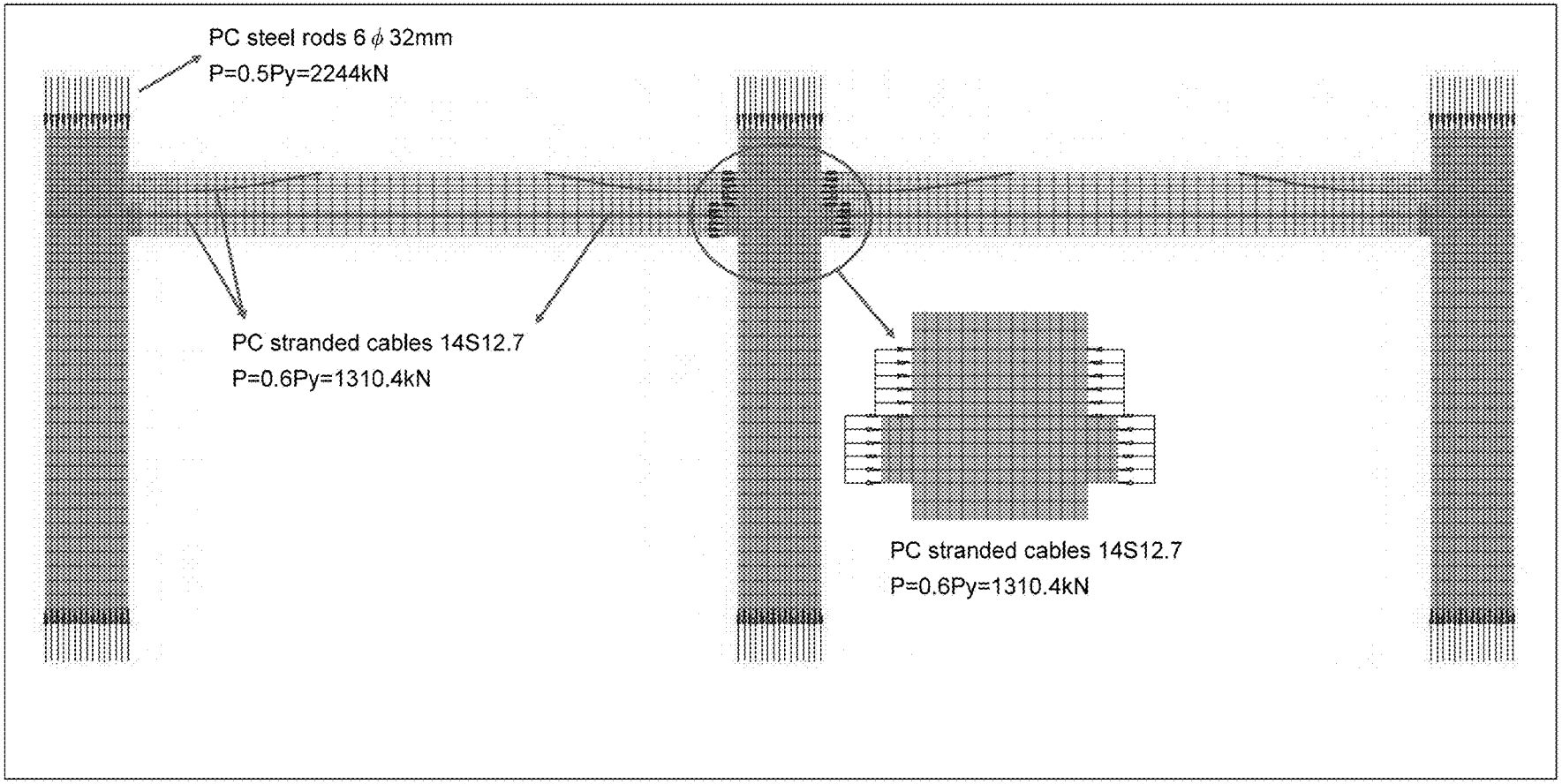
Figures 2A, 8:
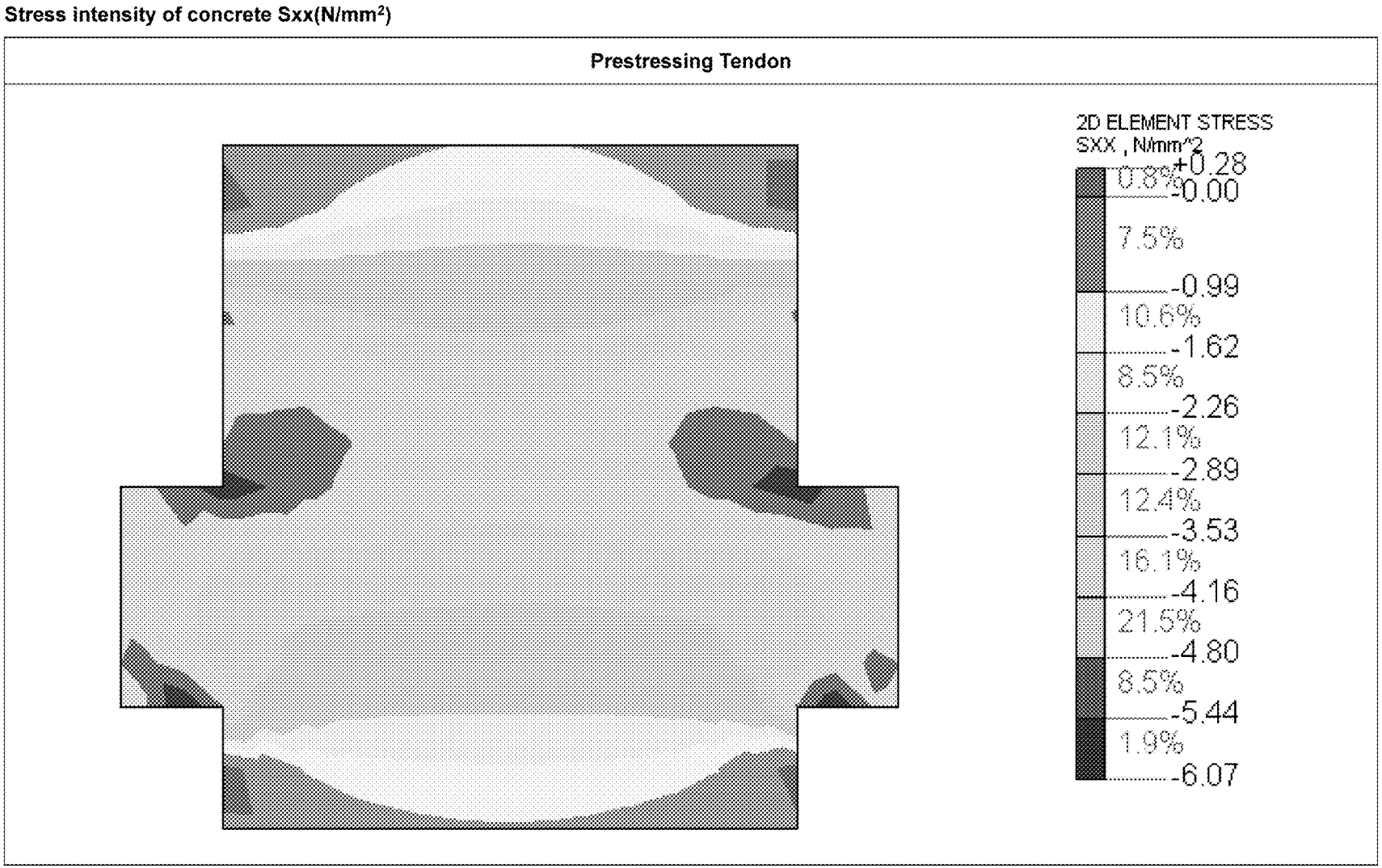
Figures 2B, 8:
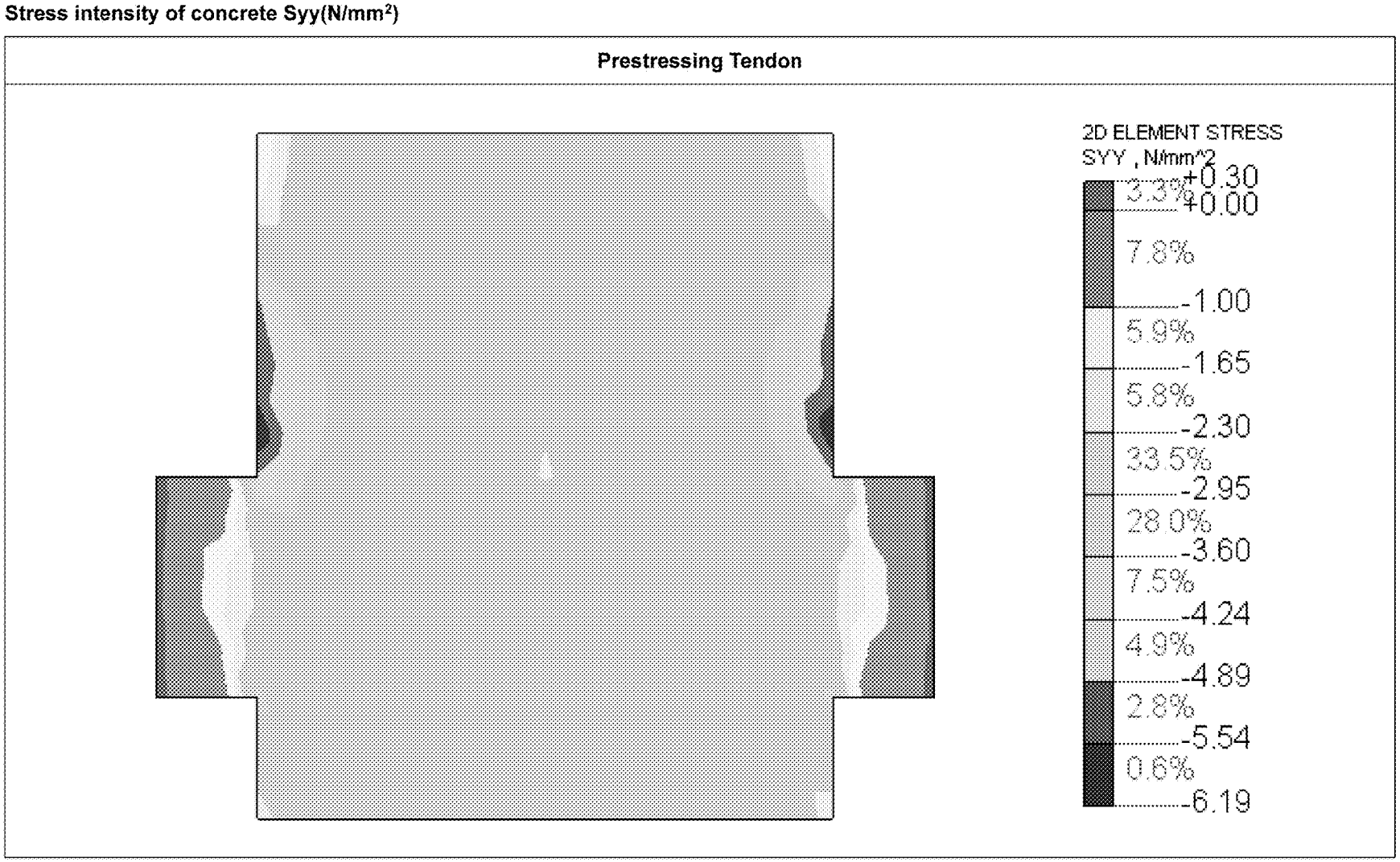
Figures 3, 8:
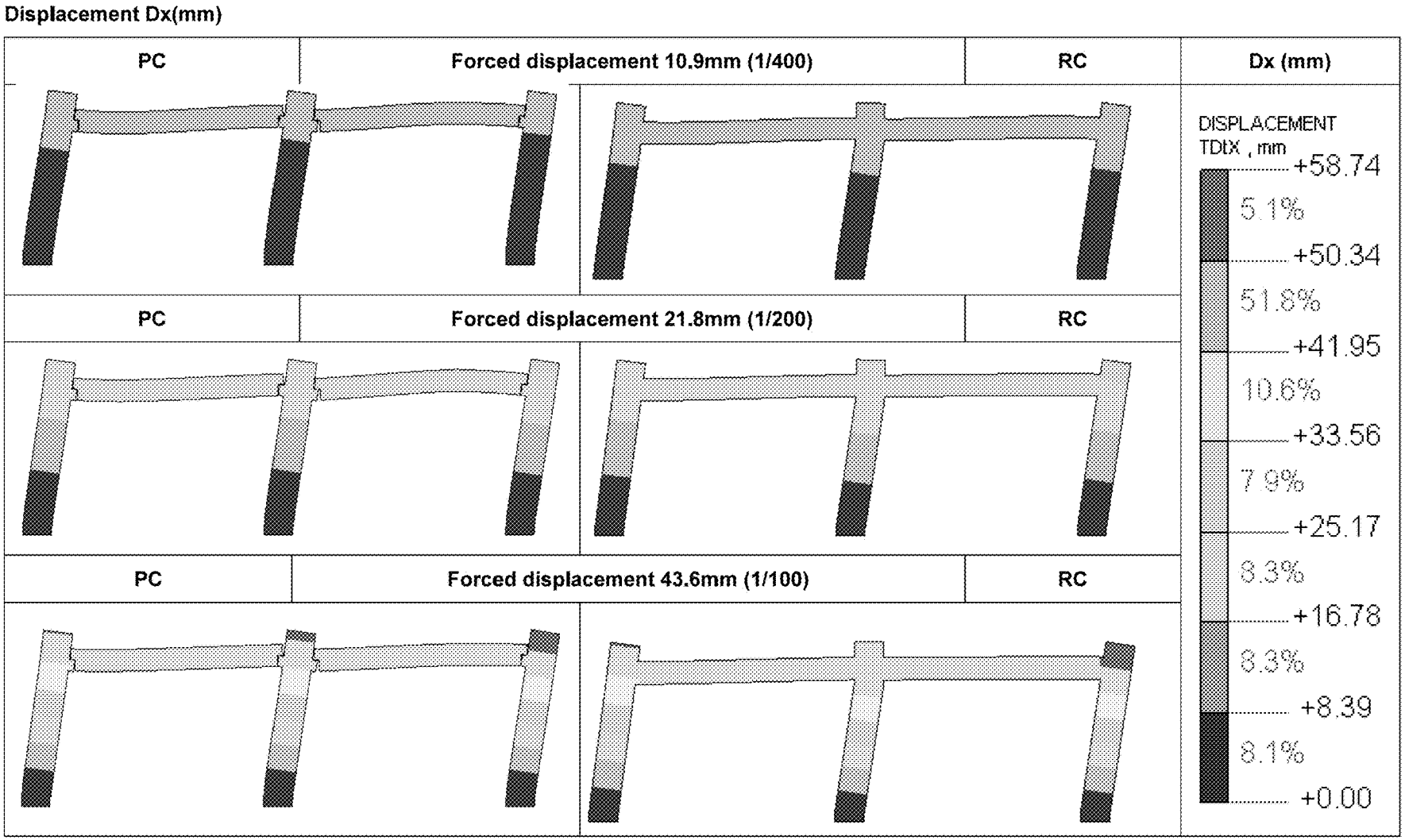
Figures 4A, 8:
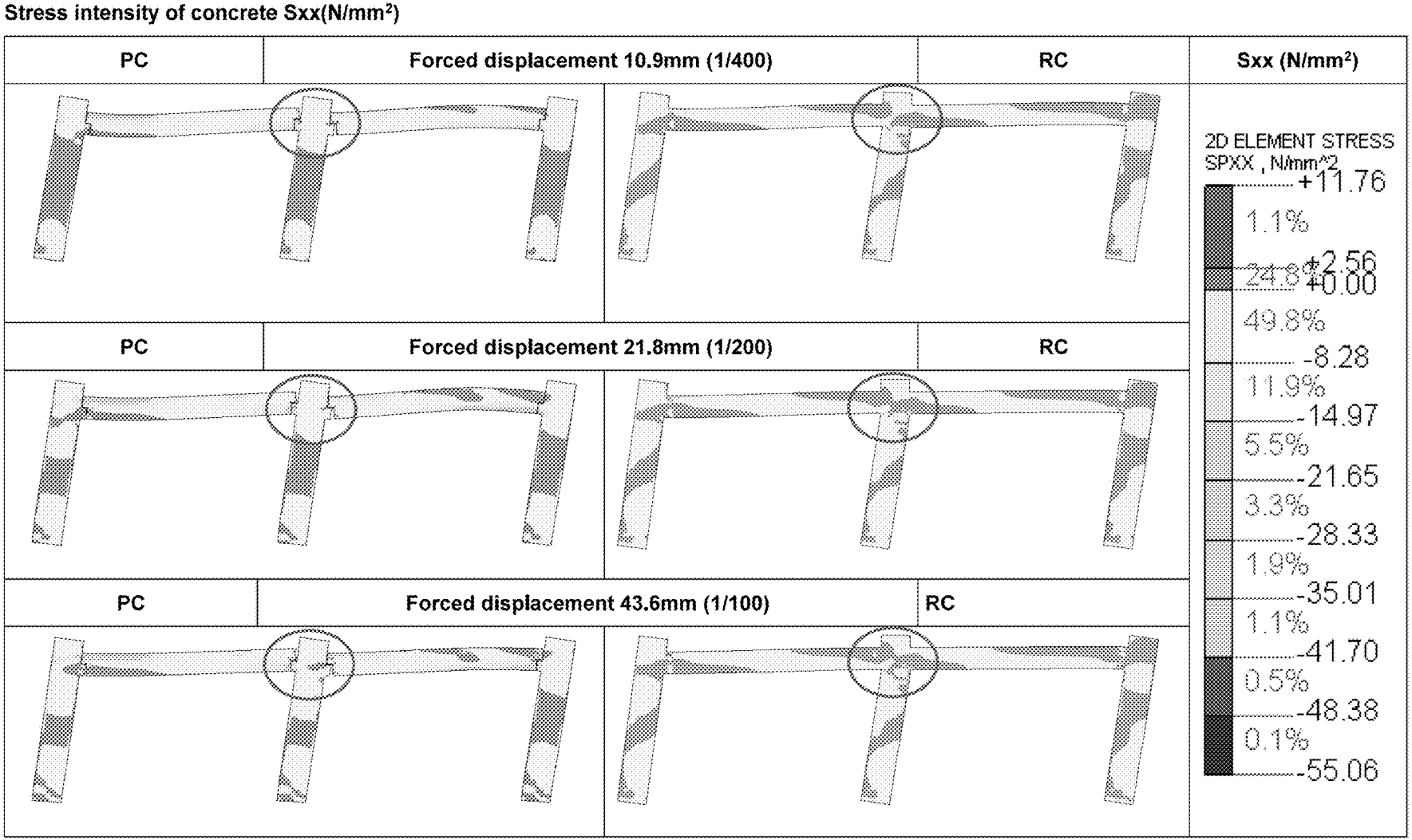
Figures 4B, 8:
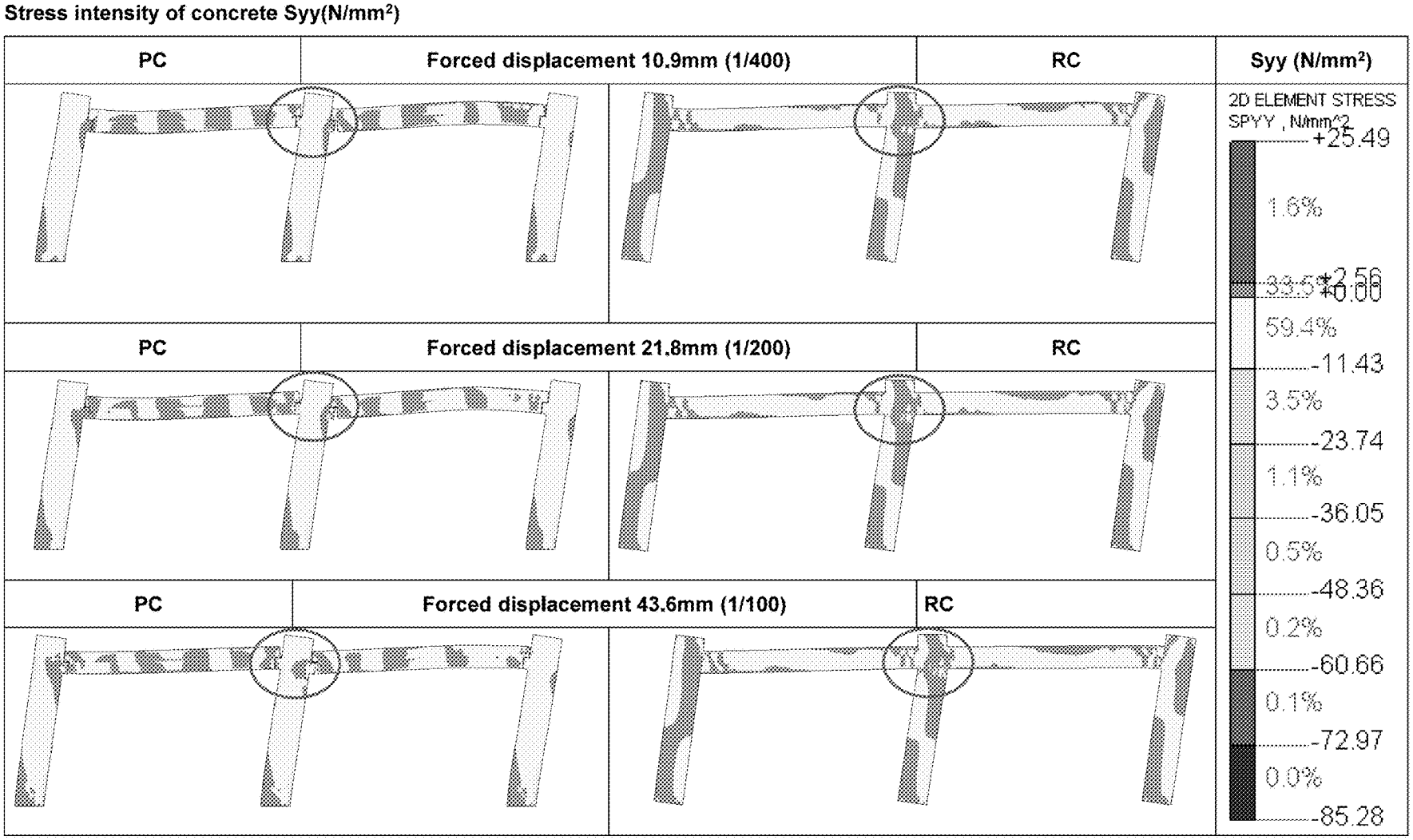
Figures 5A, 8:
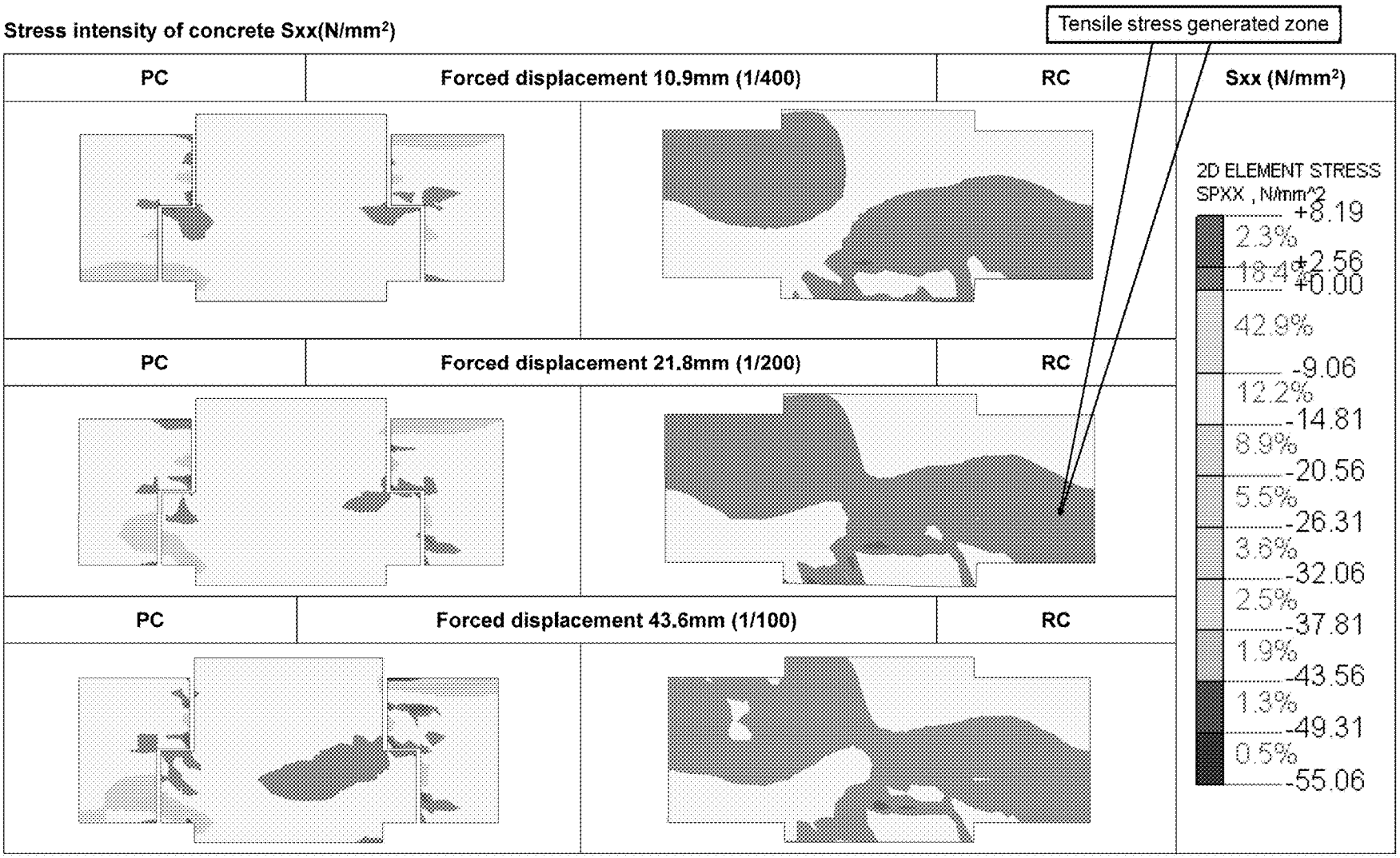
Figures 5B, 8:
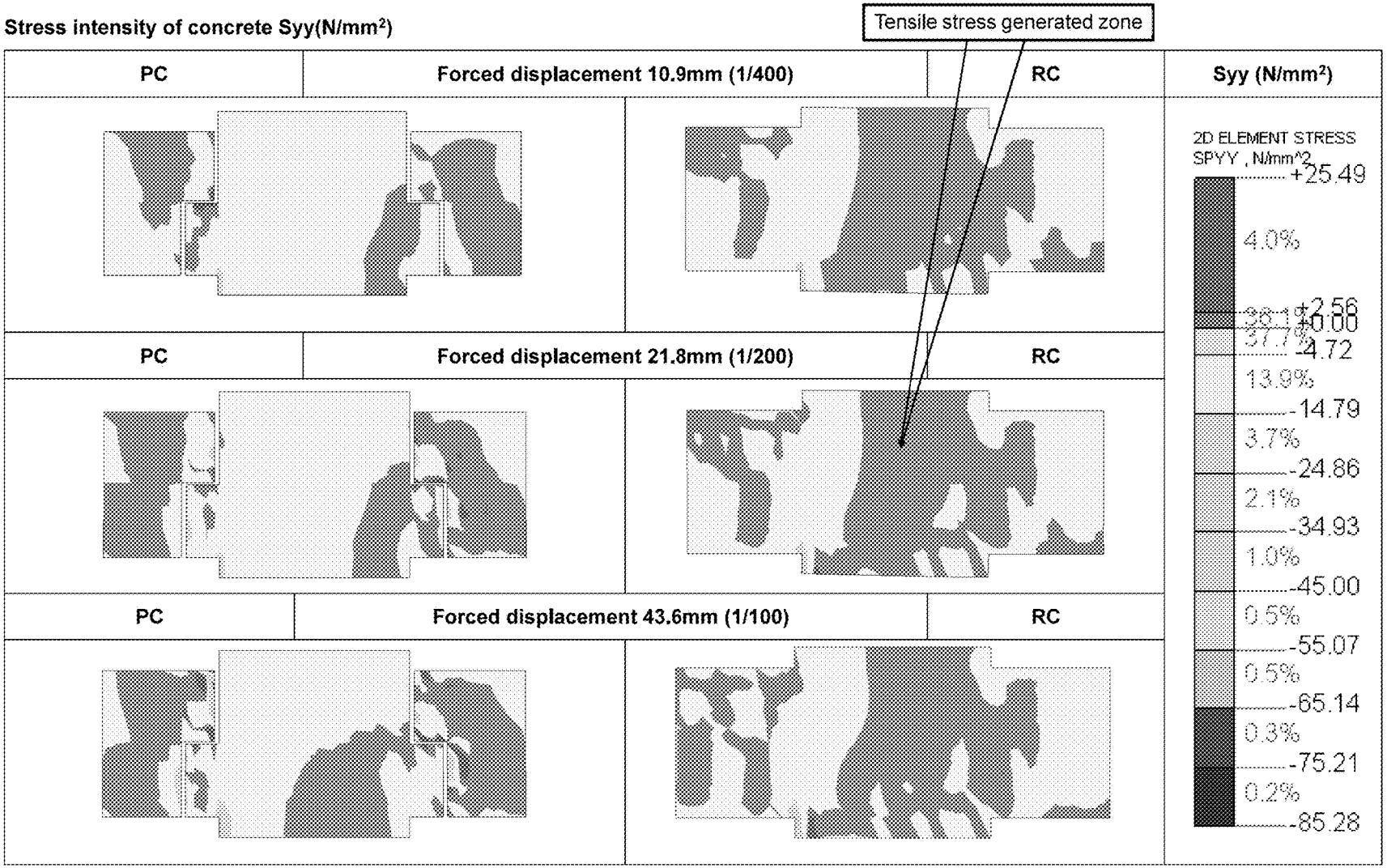

FIGS. 2A and 2B show the same structure in a plan view including the X and Y axes and a side view including the X and Z axes, respectively. In FIGS. 2A and 2B, to facilitate understanding of the present invention, the illustration of the prestressing tendons is eliminated, and prestresses ($\sigma x$, $\sigma y$, $\sigma z$) acting on the beam-column joints 10 are indicated by arrows to show that the beam-column joints 10 are in triaxial compression.

FIGS. 2C to 2E show the cross sectional shapes of the beam extending along the X axis and Y axis and the column extending along the Z axis at their end faces as a 2C-2C cross sectional view, a 2D-2D cross sectional view, and a 2E-2E cross sectional view respectively.

In the method according to the present invention, the operation of tensioning and anchoring secondary cables serving as prestressing tendons provided in the beam members 2 and passed through the beam-column joints 10 is performed before providing the top concrete 20. Therefore, the cross-sectional areas at the ends 7 of the beams do not include the top concrete 20, in calculation of the prestresses $\sigma x$ and $\sigma y$.

However, the cross section of the ends 7 of the beams are included as composite cross section inclusive of top concrete 20 (that is, composite T-shaped cross sections including precast concrete and cast-in-site concrete arears), so as to generate no tensile stress intensity with respect to long-term design load.

Normally, top concrete and slab are integrally formed by cast-in-situ concrete, and upper portion of the beam-column joint (panel zone) 10 is surrounded by slab and is deemed as rigid area which is not influenced by seismic load. Accordingly, in the present invention, the beam-column joint (panel zone) 10 does not include top concrete 20, and means a hatched portion shown in FIG. 2.

Further, prestress $\sigma$ ($\sigma x$, $\sigma y$, $\sigma z$) is a composite value of tensioning force introduced by PC tensioning tendons with taking influences caused by eccentricity of the centroid of the PC tensioning tendon into account. In other words, the calculated value of the prestress $\sigma$ ($\sigma x$, $\sigma y$, $\sigma z$) is a composite value obtained with taking influences by P/A and P·e into account, where "P" denotes effective tension introducing force introduced by the prestressing tendons, "A" denotes the cross-sectional area at the end of each of the beam or column member as described above, in which no top concrete is included.

Prestress $\sigma$ ($\sigma x$, $\sigma y$, $\sigma z$) introduced into the cross section has uniform distribution in the case where no eccentricity is present at the centroid of the PC tensioning tendon, but has no uniform distribution in the case where the centroid of the PC tensioning tendon is eccentric. In any case, both the cases are out of the present invention.

In this description, the terms "PC column 1" and "PC beam 2" are used to refer to those which are prestressed over their entire length, which may include components that are prestressed by primary prestressing tendons (i.e. those prestressed in the factory) and components that are prestressed by secondary prestressing tendons (i.e. those prestressed at the site of construction).

The primary prestressing tendons are not illustrated in the drawings. Prestressing by primary prestressing tendons is conducted in the factory, and tensioning may be performed by either pre-tensioning or post tensioning. Tensioning of the secondary prestressing tendons is performed at the site of construction by post-tensioning. In the following description, prestressing cables used as secondary prestressing tendons will also be referred to as secondary cables.

FIG. 3 is a detailed side view of the beam-column joint 10 formed by the precast PC column 1 and the PC beam 2 crossed each other, as shown in FIG. 1. The beam end 7 of the PC beam 2 is integrated with the column member 1 by the tensile force of the PC cables 31 serving as PC prestressing tendons. Therefore, in this example, the beam end 7 is a column-beam PC pressure-connected portion (surface).

The column 1 has two column ends 6. One of the column ends 6 is a PC pressure-connected portion (surface) at the upper end of the top concrete 20 in which the columns are integrated by PC pressure-connected joint by a PC steel rods 3 serving as a PC tensioning member. The other of the column ends 6 is a cross section of the boundary between the column-beam joint 10 and the PC column 1 located at the lower end of the beam 2.

In the present invention, the cross section of the beam end 7 or the column end 6 means the cross section of the PC pressure-connected joint (surface) joining the member body, or the cross section of the boundary between the continuous body of the member body and the column beam joint 10. In each cross section, the tensile stress degree is not generated in the cross section of the beam end 7 or the column end 6 with respect to the long term design load. That is, it is in a stress state of full prestress.

Figure 4A:
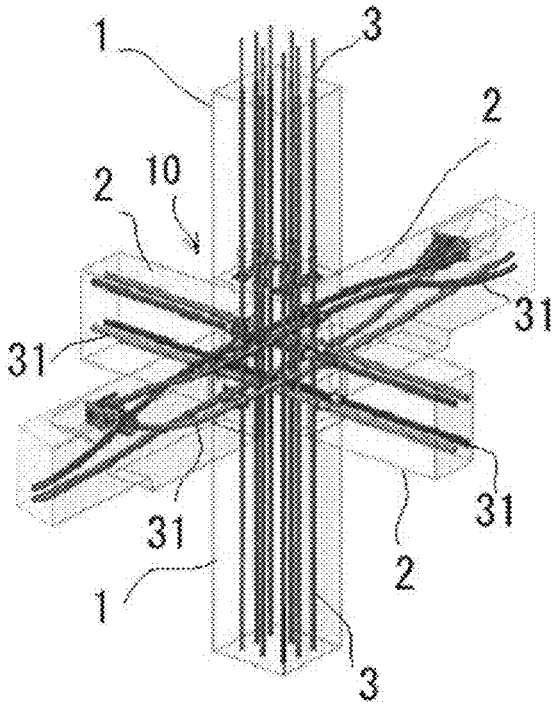
FIG. 4A is a perspective view illustrating an arrangement of prestressing tendons in a beam-column joint.
Figure 4B:
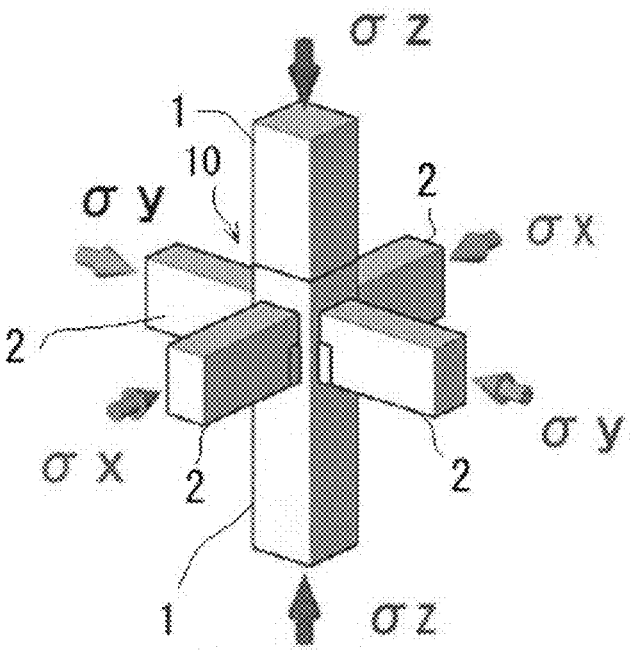
FIG. 4B is an explanatory view illustrating directions of triaxial compressive stresses on the beam-column joint.

FIGS. 4A and 4B show how prestress is introduced in the beam-column joint 10 in triaxial compression according to the present invention. FIG. 4A is a perspective view illustrating prestressing tendons set in the beam-column joint 10, and FIG. 4B is a view illustrating how triaxial compressive stress acts on the beam-column joint.

As shown in FIGS. 4A and 4B, in order to satisfactorily cancel diagonal tensile force by establishing triaxial compression of the beam-column joint, it is necessary to introduce prestresses ($\sigma x$, $\sigma y$, $\sigma z$) in the beam-column joint 10 in three axial directions. Moreover, since they affect necessarily prestresses to be introduced into the cross sections of the column ends and the beam ends surrounding the beam column joint 10, it is very important to determine properly magnitudes of the prestresses ($\sigma x$, $\sigma y$, $\sigma z$), so as to satisfy requirement of constructive performance of both the ends, thereby PC construction having aseismatic performance required for the PC column 1 and the PC beam 2 inclusive of the beam-column joint 10, being obtained.

Figure 5B:
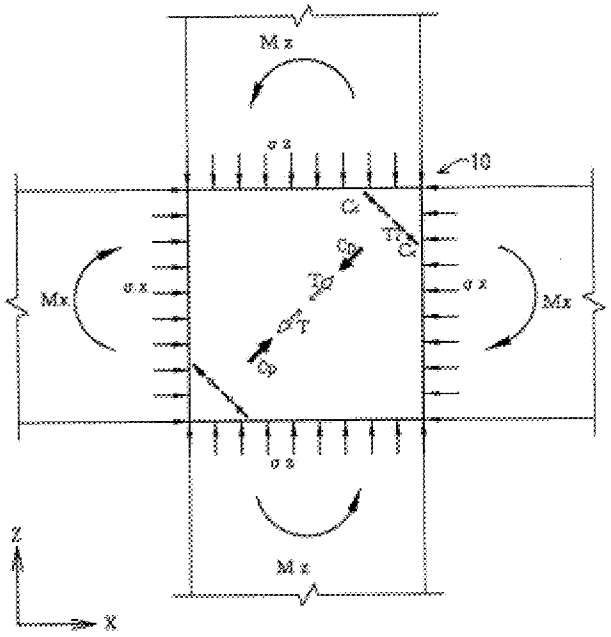
FIGS. 5A and 5B illustrate relationship between stresses in a beam-column joint and cracks occurring therein.
Figure 5A:
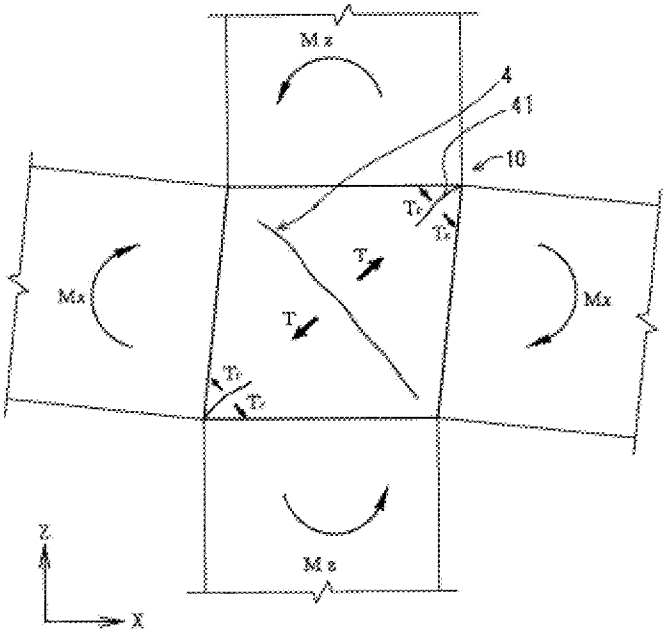

Advantageous effects of the present invention will now be described with reference to FIGS. 5A and 5B. FIGS. 5A and 5B illustrate relation between the stress in the beam-column joint 10 and the occurrence of cracks.

FIG. 5A shows a panel zone of a conventional RC construction on which a seismic load is acting on the building as a right action. Though not shown in the drawings, when a seismic load is acting on the building as a left action, the locations and directions of the stress, deformation, and cracks are reverse to those in FIG. 5A.

In the beam-column joint 10 of a conventional RC construction, when a great earthquake occurs, an input shear force (not shown) acts on the structural frame in the X-Z direction due to the seismic load, and the input shear force generates bending moments Mx and Mz on the ends of the beams and the columns respectively in the X-Z plane. On the column 1 is acting a vertical stationary load (N) as an axial force, the magnitude of which is not uniform but varies depending on the floor level. On the other hand, no axial force acts on the beam generally. Because constraint against the bending moments caused by the seismic load cannot be provided, there arises a relative displacement between the columns 1 on the vertically upper end and lower end of the beam-column joint (or panel zone), and the ends of the horizontally left and right beams deform rotationally to make the beam-column joint 10 rhomboidal as shown in FIG. 5A. In consequence, the bending moments Mx, Mz acting on the ends of the beams and the columns generate a tensile stress on one side of the cross section of the beams and the columns and a compressive stress on the other side, though not shown. This tensile stress generates resultant diagonal tensile forces (T and Tc) along a diagonal and at corners of the beam-column joint, leading to the occurrence of cracks along the diagonals (including a diagonal crack 4 along the diagonal and diagonal cracks 41 at corners). This eventually causes a brittle shear failure, which probably leads to fatal collapse of the entire structural frame.

There may be cases where one of the diagonal crack 4 along the diagonal and the diagonal cracks 41 at corners occurs and cases where both of them occur. The occurrence of diagonal crack(s) along a diagonal mentioned in the description of the present application includes both the cases.

FIG. 5B shows a beam-column joint 10 in triaxial compression by prestress introduced according to the present invention. While FIG. 5B shows only the X-Z plane, the following description also applies to the Y-Z plane, though not shown in the drawings.

As shown in FIG. 5B, a seismic load tends to generate diagonal tensile forces in the beam-column joint (or panel zone) 10 including tensile forces T along a diagonal and tensile forces Tc at corners as in the above-described conventional structure. However, because the beam-column joint (or panel zone) 10 is strongly constrained from outside by virtue of the prestress σ (σx and σz in FIG. 5B) introduced thereto, the beam-column joint 10 does not deform unlike with the conventional structure.

Moreover, in accordance with the condition (2) according to the present invention which reads "(2) . . . no generation of diagonal cracks is allowed, and diagonal tensile stress intensity caused due to input shear forth by seismic load is made less than an allowable tensile stress intensity of concrete", a specific prestress a (σx, σy, σz) is introduced so that a resultant compressive force Cc may be generated at corners, in addition to a resultant compressive force Cp on the diagonal line, so the tensile forces T and Tc completely or partially are cancelled, thereby preventing the occurrence of diagonal cracks.

According to the condition (1) of the present invention, "no tensile stress intensity is generated, with respect to long term design load, in cross-section areas of the ends of the beams and of the ends of the columns which cross-section areas form the beam-column joint". By satisfying both of the above conditions (1) and (2), the respective values of stresses σ (σx, σy, and σz) are determined, thereby effective and reasonable prestresses σ (σx, σy, and σz) being able to be introduced, respectively.

There may be cases where the tensile force T on a diagonal is cancelled by the resultant compressive force Cp only partially and the tensile force T partly remains. According to the present invention, prestressing tendons are set and anchored in such a way as to introduce specific prestresses according to the above condition (2) so that the resultant compressive forces will make the tensile stress intensity (i.e. tensile stress per unit area) on a cross section of the concrete lower than the allowable tensile stress intensity of the concrete used to construct the beam-column joint, even if the tensile force T partly remains, thereby preventing diagonal cracks of concrete from occurring.

For example, if the design standard strength Fc of the concrete used to construct the beam-column joint 10 is 60 $N/mm^2$, the allowable tensile stress ft of the concrete is as follows: $ft=\frac{1}{30}Fc=2\ N/mm^2$. Prestress is introduced in such a way as to make a tensile stress intensity resulting from the aforementioned partially remaining tensile force T (if it remains) lower than the allowable tensile stress intensity of the concrete. This also applies to the tensile forces Tc occurring at corners.

In conventional PC structures constructed using precast PC columns 1 and precast PC beams 2, a beam member and a column member are connected together by full pressure connection. Specifically, prestressing tendons passing through the column are tensionally anchored to the end 7 of the beam. It is considered sufficient that the tension introducing force for this purpose be set in such a way as to meet requirements of PC pressure connection of the end of the beam to the column. Likewise, in conventional PC structures, to connect two column members 1 together by PC pressure connection, prestressing tendons are arranged along the axial direction of the columns, and required prestressing force and PC pressure connection force resisting against shearing force are introduced.

In conventional structures, no consideration has been given to relationship between the prestressing in the X and Z directions or Y and Z directions for the purpose of generating a resultant compressive force Cp on a diagonal of the beam-column joint (or panel zone) which force is required to cancel diagonal tensile force T along the diagonal line of the beam-column joint. In other words, in conventional structures, stress introducing forces in the respective directions have been applied only for the purpose of achieving full pressure connection of the members. Therefore, it is not secured that an effective resultant compressive force Cp is generated on a diagonal of the beam-column joint (or panel zone) 10. Likewise, no consideration has been given to generation of compressive forces at corners of the beam-column joint (or panel zone) 10.

According to the present invention, prestresses are so determined that both of the conditions (1) and (2) are satisfied at the same time, so that the effective resultant compressive force Cp and the compressive force Cc generated at the corner are generated along the diagonal lines of the beam-column joint (panel zone) 10, by which generation of diagonal cracks are prevented securely.

Meanwhile, prestresses are introduced into PC pressure-connected portions (surfaces) between the precast members to satisfy the conditions (1) and (2) according to the present invention, but it is needless to say that, with respect to shearing forces due to long term design load and short term seismic load, it is necessary to introduce specific PC pressure connection force(friction connecting force) as conventionally required. It is noted that, with respect to shearing force due to short term seismic load, shear resistance force at the corbel or cogging is taken in account to share with PC pressure connection force (friction connecting force).

Figure 6A:
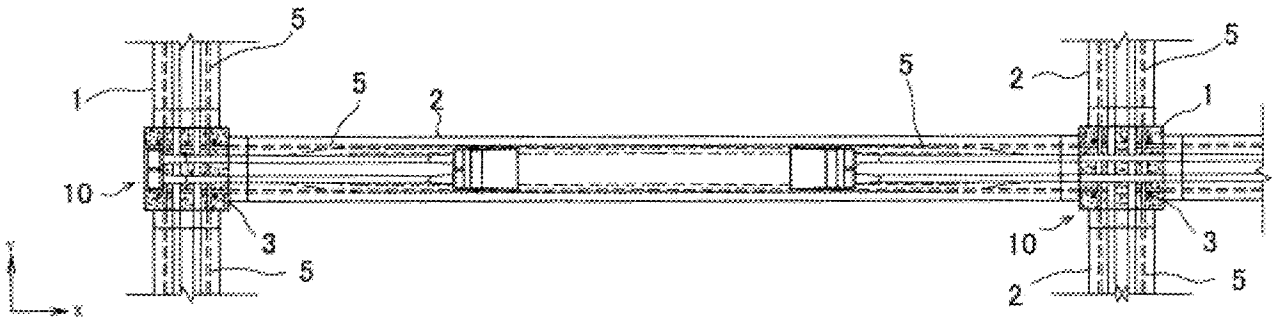
FIGS. 6A to 6C show a semi pressure contact PC structure including a beam-column joint formed by cast-in-situ concrete.
Figure 6B:
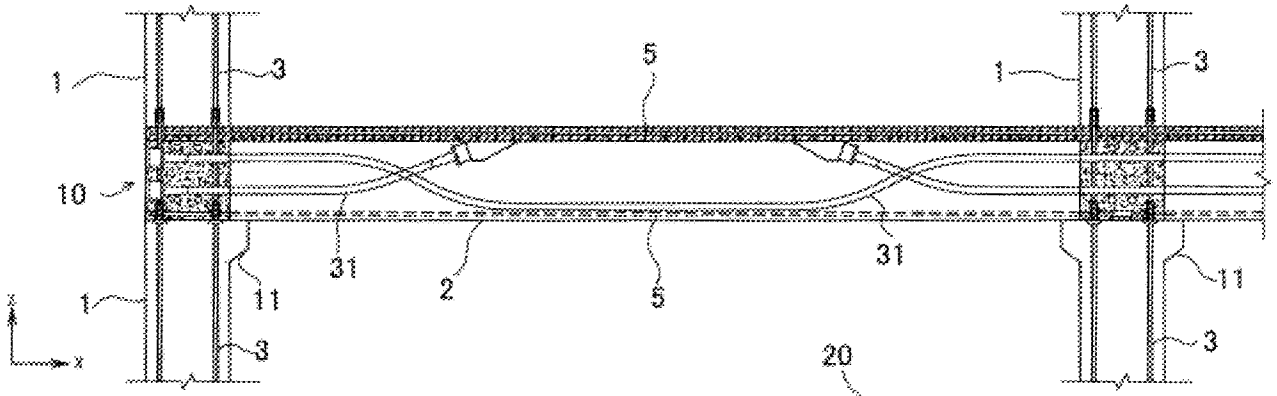
Figure 6C:
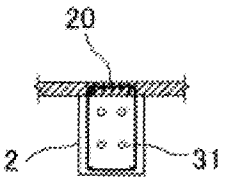

FIGS. 6A to 6C show a case where a PC structure is constructed by layered construction. In this case, columns and beams are prepared as precast members, and beam-column joints (or panel zones) 10 are constructed by concrete cast in situ. Precast beam members may be joined together by fixing reinforcing bars extending from the precast beam members to a beam-column joint portion 10. Regarding precast column members, though not shown in the drawings, reinforcing bars extending from a precast column member are extended through a beam-column joint, so that the upper precast column member may be connected with another precast column member, using a mortar-filled joint or the like in some cases, as shown in FIG. 5 of Patent Literature 3 (Japanese Patent No. 4041828). In such cases, while the beam members and the column members are made of PC structure, the beam-column joints 10 are made of RC structure.

In some conventional layered constructions, the amount of reinforcing bars is reduced to provide prestressing tendons, and tension introducing forces are applied. In such cases, connections of members are achieved by semi pressure connection instead of full pressure connection, leading to a much smaller number of prestressing tendons required than in full pressure connection. This is economical.

In this case, the prestress introduced in the beam-column joint 10 is much lower. Therefore, in layered constructions, it is difficult to generate effective resultant compressive forces (Cp and Cc) in beam-column joints (or panel zone) 10.

Accordingly, in PC structures constructed by the conventional layered construction, beam-column joints are made of RC (reinforced concrete) or PRC (prestressed reinforced concrete), which are more vulnerable to diagonal cracking than ordinary beam-column joints made of PC. Therefore, the need for reinforcement by prestressing is higher in structures using semi pressure connection than in structures using full pressure connection.

In the method according to the present invention, in addition to arranging the prestressing tendons in triaxial directions (X, Y, Z) in the beam-column joints as adopted in the conventional method, the following conditions (1) and (2) are satisfied:

(1) in the cross section areas of the members forming the beam-column end and the column end, no tensile strength is made to be generated for the long term design load; and (2) in the beam-column joint, upon occurring of large scale earthquake (extremely rarely occurred earthquake), no generation of diagonal cracks is allowed but diagonal tensile stress intensity is made less than allowable tensile stress intensity of concrete. Thus, proper prestresses can be introduced.

Further, taking the axial force acting on the columns into account, prestress $\sigma z$ in the vertical direction Z is reduced to determine the proper ranges of prestresses $\sigma x$, $\sigma y$ and $\sigma z$, thereby it becoming possible to give prestresses which meet with reference strength of concrete design standard often used for PC construction, so that resultant compressive forces (Cp and Cc) which are not too large nor to small and are effective for the beam-column joint (panel zone), may be obtained.

Figure 7:
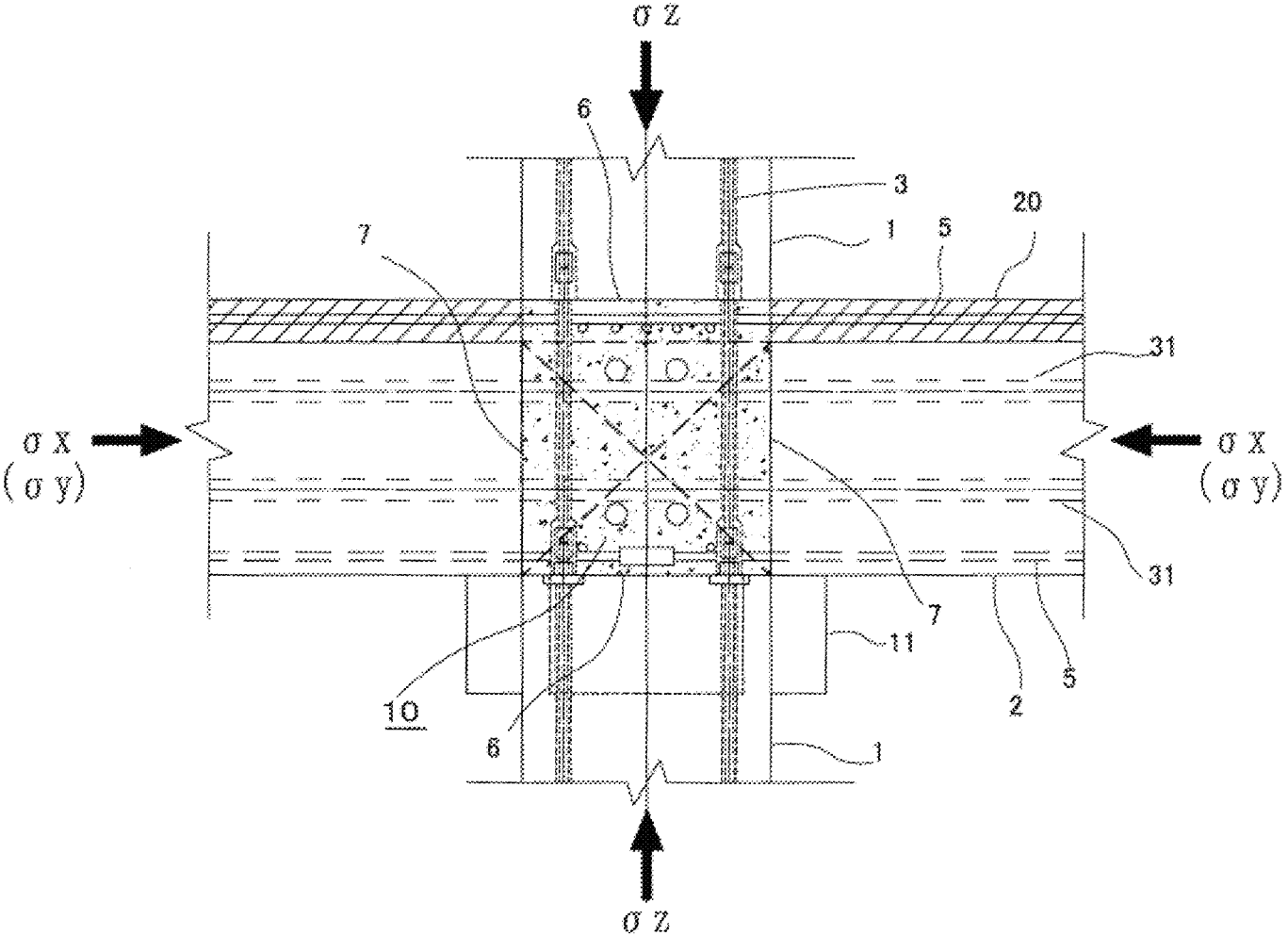
FIG. 7 is an enlarged side view showing a portion of the beam-column joint shown in FIG. 6.

FIG. 7 shows a detailed side view illustrating the beam-column joint (panel zone) 10 in the layered constructions shown in FIG. 6, in which the column 1 and the beam 2 are precast members, and the PC column 1 and the PC beam 2 are crossed to form the beam-column joint (panel zone) 10 constructed by concrete cast in site.

The ends 7 of the precast beams 2 and the beam-column joint (panel zone) 10 are connected integrally by the PC cables 31 as the PC tensioning members, the lower end reinforcing bars 5 and the upper end reinforcing bars 5 so as to make socalled semipressure connection.

There are two ends 6 of the column 1, one of which is at the upper end of the top concrete 20 and forms the beam-column joint 10 by connected integrally with the PC steel rods 3 and, as the case may be, with reinforcing bars (not illustrated), as an example, under semipressure connection. The other end can be at cross section where a portion of the beam-column joint 10 situated corresponding to the lower end of the beam 2 is joined to the PC column 1. In this case, the corbel or cogging is not included in the member forming the column end 6.

The process of layered construction shown in FIGS. 6A to 6C will now be described.

Firstly, precast PC columns 1 are set upright on the foundation (not shown), and prestressing steel rods 3 serving as prestressing tendons are passed through the PC columns 1 and tensionally anchored. Then, precast PC beams 2 are set on corbels 11 provided on the PC columns 1, and bottom reinforcing bars 5 extending from ends of adjacent PC beams 2 are connected by reinforcing bar joints. The bottom reinforcing bars 5 may be connected by lap joint without using reinforcing bar joints, alternatively. Then, wires and reinforcing bars are arranged in the beam-column joints (or panel zones) 10, and concrete having a compression strength equal to or higher than the PC beams 2 is poured in situ up to the level as high as the upper face of the precast PC beams 2 and cured. After the concrete is cured, prestressing cables 31 serving as prestressing tendons arranged in the PC beams 2 are tensionally anchored to introduce prestress in two horizontal directions (X, Y).

Then, upper top reinforcing bars 5 are set on top of the precast PC beams 2, and top concrete 20 and a slab are formed together. Normally, the concrete of the PC beams 2 and the slab have different strength, specifically the PC beams 2 have higher strength. Therefore, cast-in-situ concrete in the beam-column joint (or panel zone) 10 is poured and cured in two stages.

After the top concrete is cured, a precast PC column 1 of the upper floor is set on the beam-column joint 10, and prestressing steel rods 3 serving as prestressing tendons are connected by couplers and tensionally anchored to introduce prestress in the vertical direction (or Z direction). In a case when reinforcing bars are extended into the PC column 1 of the upper floor, the reinforcing bars are passed through the beam-column joint before pouring concrete, and after the concrete has been poured and cured, the reinforcing bars are connected with the column member of the upper floor by connecting the reinforcing bars by mortar-filled joints.

In the case of the beam-column joint (or panel zone) 10 constructed by layered construction described above, the cross-sectional area at the end of the beam does not include the top concrete, as with the embodiment shown in FIGS. 1A and 1B, where all the components used are precast members. Therefore, relationships represented by the conditions (1) and (2) can be applied to this case also.

The method of introducing prestress in a beam-column joint according to the present invention can also be applied to PC structures constructed by cast-in-situ prestressed concrete in which all of the PC columns, PC beams, and beam-column joints (panel zones) are constructed by concrete that is cast in situ, though not shown in the drawings.

In this case, the cross-sectional area at the end of the beam shall be construed as the cross-sectional area at the time when prestressing tendons are tensionally anchored to introduce prestress. For example, in cases where the slab has not been formed on the beam at the time of tensional anchoring, the cross-sectional area shall be construed not to include the slab. In cases where tensional anchoring is performed after the beam and the slab are formed, the cross-sectional area shall be construed to include the slab.

It is desirable that, at least five layers (or stories) of a building are grouped, and the same prestress is introduced in the PC columns in the same group of layers. This will be described in the following.

The axial force acting on columns varies depending on layers (or floor levels) of the building. Therefore, it is preferable that the prestress introduced in the columns be adjusted according to the variations in the axial force to uniformize the sum of the axial force and the prestress. However, controlling the tension is a very troublesome and difficult task. In the present invention, an allowable range ($\sigma z$=0.3-9.0) is set for the ratio of the stress introduced in the columns to the stress introduced in the beams, to allow the same stress to be set for the columns in five layers in the same group. This facilitates the design and construction of the building.

For example, in a ten-story building of PC structure, a certain number of prestressing steel rods are provided in each column in the first to fifth floors. Because the axial force decreases in the columns in the sixth to tenth floors, the number of prestressing steel rods provided in each column in the sixth to tenth floors is increased to compensate the decrease accordingly. This provides a practical method of introducing prestress that allows the sum of the axial force and the prestress acting on columns in these layers to readily fall within the allowable range ($\sigma z$=0.3-9.0) while enabling simplification in design and construction of the building.

An extremely great earthquake is so rare as to occur once in the lifetime of a building at most. Even if it occurs, the building will not be significantly damaged unless diagonal cracks occur. Therefore, even when a part of the diagonal tensile force generated at the beam-column joint remains, the building is not damaged if no diagonal crack is generated, so the tensile stress intensity may be set to be equal to or less than the allowable tensile stress of concrete. This is applied when priority is given to reducing construction costs by reducing PC tendons.

As to whether the prestress introducing method of the present invention is proper and effective, results of an FEM analysis conducted on the exemplary design embodiment as an analyzing model are explained below:

FIG. 8-1A shows a planar (X-Z) frame composed of the precast PC column and precast PC beam integrally joined under PC pressure connection with use of PC cables. The cross section area of the column is 850×850 (mm), and the cross section area of the beam is 650×600 (mm).

FIG. 8-1B shows a meshed state of the frame and PC tensioning force therein. The prestress introduced into the cross section area of the column end is $\sigma z$=3.1 (N/mm$^2$), and the prestress introduced into the cross section area of the beam end is $\sigma x$=6.7 (N/mm$^2$).

FIG. 8-2A shows prestress distributions introduced into the horizontal directions (beam directions) of the beam-column joint. The average value is generally $\sigma x$=4.1 (N/mm$^2$).

FIG. 8-2B shows prestress distributions introduced into the vertical direction (column direction) of the beam column joint. The prestress introduced into the vertical direction (column direction) of the beam column joint is generally $\sigma z$=2.3 (N/mm$^2$).

FIG. 8-3 shows comparison between the PC frame (left column) and the RC frame (right column) both forcedly horizontally displaced. The forced displacements are shown as three inter-story (inter-layer) deformation angles, 1/400, 1/200 and 1/100.

As shown in FIG. 8-3, in the PC construction, the larger the inter-story (inter-layer) deformation angle is, the larger the opening at the joint of the beam end is and the larger the deformation of the entire column due to the inclination thereof is, but there is found almost no deformation of the beam-column joint. On the other hand, in the RC construction, it is shown that, the larger the deformation of the column body is, the larger the deformation of the beam-column joint is.

FIG. 8-4A shows tensile strength generated zones caused in the horizontal direction (beam direction) of the respective beam-column joints of the PC construction and the RC construction, thick color portions showing portions where tensile stress is generated.

You will see that diagonal tensile stress is outstandingly generated over broad range along the diagonal line of the beam-column joint in the RC construction, while almost not generated in the PC construction.

FIG. 8-4B shows tensile strength generated zones caused in the vertical direction (column direction) in the respective beam-column joints of the PC construction and the RC construction, FIG. 8-4(B) showing similar tendency to FIG. 8-4(A).

FIG. 8-5A and FIG. 8-5B show, respectively, detailed distributions of tensile stress intensities generated in the horizontal direction and in the vertical direction, at the time when the beam-column joint is forced to displace in the horizontal direction.

As seen in FIG. 8-5A and FIG. 8-5B, it is acknowledged that the tensile stress intensities are generated over broad ranges, whose resultant tensioning force causes diagonal cracks in the beam-column joint.

According to the results of the FEM analysis described above, it is acknowledged that collected generation of tensioning force occurs slightly and locally, but the value of thus generated tensioning force is less than the allowable tensile stress intensity of concrete, so there is no influence against the building constructed.

From the above described results of the FEM analysis, it is acknowledged that the method of introducing prestresses according to the invention of the present application, is proper and effective.

REFERENCE SIGNS LIST

1: PC column
10: beam-column joint (or panel zone)
11: corbel (or cogging)
2: PC beam
20: top concrete
3: PC (prestressing) steel rod
31: PC (prestressing) cable
4: diagonal crack

41: diagonal crack at corner
5: reinforcing bar
6: end of column (or column end)
7: end of beam (or beam end)
T: tensile force
Tc: tensile force
Cp: resultant compressive force
Cc: resultant compressive force at corner

What is claimed is:

1. A method of introducing prestress in a beam-column joint that introduces prestress in a beam-column joint in a multi-story building structure constructed by PC columns and PC beams being characterized in that a tensile introducing force is generated by tensionally anchoring PC cables that are arranged in PC beams extending along two horizontal directions of X axis and Y axis and in PC columns extending along a vertical direction of Z axis and passed through the beam-column joint, the tensile introducing force introducing prestresses in the respective axis directions to the cross section areas of the ends of the members forming the beam-column joint and in addition to the beam-column joint to bring the beam-column joint in triaxial compression; and prestresses σx, σy, and σz introduced in the respective directions are determined to satisfy the following conditions (1) and (2), where σx, σy, and σz are prestresses introduced in the directions of the X axis, the Y axis, and the Z axis, respectively:

(1) no tensile strength is generated, with respect to long term design load, in cross-section areas of the members forming the ends of the beams and the ends of the columns; and (2) upon occurrence of an earthquake, in the beam-column joint, no generation of diagonal cracks is allowed but diagonal tensile stress intensity caused due to shear force inputted by seismic load is made less than allowable tensile stress intensity of concrete, the values of σx, σy and σz falling within the ranges as shown below:

$2.0 \leq \sigma x \leq 10.0$ (N/mm$^2$)

$2.0 \leq \sigma y \leq 10.0$ (N/mm$^2$)

$0.6 \leq \sigma z \leq 9.0$ (N/mm$^2$).

* * * * *